US012594595B2

(12) United States Patent
Tomita et al.

(10) Patent No.: US 12,594,595 B2
(45) Date of Patent: Apr. 7, 2026

(54) ALUMINUM ALLOY INGOT AND METHOD FOR PRODUCING SAME

(71) Applicant: Resonac Corporation, Tokyo (JP)

(72) Inventors: Yuto Tomita, Tokyo (JP); Yoshifumi Kimura, Tokyo (JP)

(73) Assignee: Resonac Corporation, Tokyo (JP)

( * ) Notice: Subject to any disclaimer, the term of this patent is extended or adjusted under 35 U.S.C. 154(b) by 0 days.

(21) Appl. No.: 18/688,128

(22) PCT Filed: Aug. 29, 2022

(86) PCT No.: PCT/JP2022/032392

§ 371 (c)(1),
(2) Date: Feb. 29, 2024

(87) PCT Pub. No.: WO2023/032911

PCT Pub. Date: Mar. 9, 2023

(65) Prior Publication Data

US 2024/0375172 A1 Nov. 14, 2024

(30) Foreign Application Priority Data

Sep. 3, 2021 (JP) ..... 2021-144263

(51) Int. Cl.
*B22D 11/00* (2006.01)
*B22D 11/055* (2006.01)
(Continued)

(52) U.S. Cl.
CPC ..... *B22D 11/003* (2013.01); *B22D 11/055* (2013.01); *C22C 21/02* (2013.01); *B22D 11/1245* (2013.01); *C22C 1/026* (2013.01)

(58) Field of Classification Search
CPC . B22D 11/003; B22D 11/055; B22D 11/1245; B22D 11/00; B22D 11/04;
(Continued)

(56) References Cited

U.S. PATENT DOCUMENTS

2018/0243822 A1 8/2018 Wagstaff
2022/0205072 A1* 6/2022 Schiffl ..... B22D 11/003

FOREIGN PATENT DOCUMENTS

JP 63-140060 A 6/1988
JP 08-029398 B2 3/1996
(Continued)

OTHER PUBLICATIONS

Toshio Haga, "Development of Twin Roll Caster with High Casting Speed and High Cooling Ability for Aluminum Alloys", Technical Article, J. JFS, vol. 86, No. 1, 2014, pp. 47-53.

*Primary Examiner* — Adil A. Siddiqui
(74) *Attorney, Agent, or Firm* — Sughrue Mion, PLLC

(57) ABSTRACT

An aluminum alloy ingot contains Cu: 0.15 mass % or more and 1.0 mass % or less, Mg: 0.6 mass % or more and 1.2 mass % or less, Si: 0.95 mass % or more and 1.35 mass % or less, Mn: 0.4 mass % or more and 0.6 mass % or less, Fe: 0.15 mass % or more and 0.70 mass % or less, Cr: 0.09 mass % or more and 0.25 mass % or less, and Ti: 0.012 mass % or more and 0.035 mass % or less, with the remainder being made up of Al and unavoidable impurities, and in the aluminum alloy ingot, a difference between a maximum value and a minimum value of secondary dendrite arm spacing in a cross section perpendicular to a casting direction of the aluminum alloy ingot is in a range of 5 μm or more and 20 μm or less.

4 Claims, 4 Drawing Sheets

(51) Int. Cl.
*B22D 11/124* (2006.01)
*C22C 1/02* (2006.01)
*C22C 21/02* (2006.01)

(58) Field of Classification Search
CPC ..... B22D 11/049; B22D 11/22; C22C 21/02; C22C 1/026; C22C 1/02; C22C 21/06; C22F 1/00; C22F 1/05
See application file for complete search history.

(56) References Cited

FOREIGN PATENT DOCUMENTS

| | | | |
|---|---|---|---|
| JP | 2006-150448 | A | 6/2006 |
| JP | 2007-092125 | A | 4/2007 |
| JP | 2008-030062 | A | 2/2008 |
| JP | 2010-253554 | A | 11/2010 |
| JP | 4643388 | B2 | 3/2011 |
| JP | 4648968 | B2 | 3/2011 |
| JP | 5295205 | B2 | 9/2013 |
| JP | 5366063 | B2 | 12/2013 |
| JP | 2015-208748 | A | 11/2015 |
| JP | 2017-080775 | A | 5/2017 |
| KR | 10-2009-0022883 | A | 3/2009 |
| WO | 2014/064876 | A1 | 5/2014 |

* cited by examiner

ALUMINUM ALLOY INGOT AND METHOD FOR PRODUCING SAME

TECHNICAL FIELD

The present invention relates to an aluminum alloy ingot, and a method for producing an aluminum alloy ingot produced using a horizontal continuous casting apparatus.

This application is a National Stage of International Application No. PCT/JP2022/032392 filed Aug. 29, 2022, claiming priority is claimed on Japanese Patent Application No. 2021-144263, filed Sep. 3, 2021, the content of which is incorporated herein by reference.

BACKGROUND ART

When a high-quality aluminum alloy ingot having excellent strength and durability is produced, it is important to form a fine and uniform metal structure in order to obtain excellent mechanical properties and stable quality. If the metal structure becomes coarse or non-uniform, mechanical properties deteriorate compared to a uniform metal structure, and there is a concern of the reliability of the final product produced using such an aluminum alloy ingot being reduced.

The composition of the metal structure of such an aluminum alloy ingot is determined in a casting step, and this composition remains in the final product. That is, in order to create a fine and uniform metal structure, it is very important to control the metal structure in the casting step.

In the related art, in the aluminum alloy ingot casting step, in order to obtain a fine and uniform casting structure, it is effective to apply a higher cooling rate to the molten aluminum alloy (hereinafter referred to as a molten metal) and cool and solidify the molten metal in a short time. For example, in the continuous casting method that is often used in wrought alloy producing methods, since a method of cooling a molten metal by cooling a mold that comes into contact with the molten metal is used, there is a limit to increasing the cooling rate due to heat accumulation in the mold itself.

In order to increase the cooling rate of the molten metal, it is necessary to reduce the thickness of the ingot to be cast so that the entire molten metal is cooled and solidified more quickly. However, if the ingot itself is made too thin, it is difficult to mold it into a medium-sized or large-sized member as a product, and there is a problem that the degree of freedom in the shape of the final product is restricted.

In addition, by simply increasing the cooling rate, it is possible to form a fine and uniform metal structure in a part of the ingot, particularly in the vicinity of the surface layer, but between the vicinity of the surface layer of such an ingot and the center of the ingot, the non-uniformity of the metal structure increases due to the difference in the cooling rate. Specifically, there is a concern that the crystal grain size and distribution of second phase particles may become uneven, which adversely affects properties of the final product.

In the related art, a casting apparatus and casting method in which an ingot having a uniform metal structure can be obtained by improving casting conditions and the configuration of the casting apparatus are known (for example, refer to Patent Documents 1 to 4).

In addition, a method of casting a thin sheet material in which non-uniformity of the metal structure is minimized while applying a high cooling rate is also known (for example, refer to Non-Patent Document 1). In addition, a method of obtaining a wire having a uniform metal structure by performing drawing processing on a cast wire is also known (for example, refer to Patent Document 5).

CITATION LIST

Patent Document

[Patent Document 1]
Japanese Examined Patent Publication No. H08-029398
[Patent Document 2]
Japanese Patent No. 4648968
[Patent Document 3]
Japanese Patent No. 5295205
[Patent Document 4]
Japanese Patent No. 5366063
[Patent Document 5]
Japanese Patent No. 4643388

Non-Patent Document

[Non-Patent Document 1]
Toshio Haga: Foundry Engineering, 86 (2014), 1 48-53.

SUMMARY OF INVENTION

Technical Problem

However, when aluminum alloy ingots cast by the methods in the above Patent Documents 1 to 5 and Non-Patent Document 1 have a large cross section, there is a problem that the metal structure is not sufficiently refined and uniformized, and a non-uniform part remains in a part of the metal structure.

An object of the present invention is to provide an aluminum alloy ingot in which the metal structure is made fine and uniform by applying a high cooling rate and the non-uniformity of the metal structure is minimized inside the ingot, and a method for producing the same.

Solution to Problem

In order to achieve the above object, the inventors have focused on a dendrite arm spacing (hereinafter referred to as DAS) among properties of the metal structure. That is, in a coagulation procedure when an aluminum alloy ingot is cast, α-Al primary crystals produced by coagulation have the form of dendritic crystals (dendrites), and a metal structure is formed according to the generation and growth of α-Al dendrites. The DAS has a relationship proportional to the cooling rate when the ingot is coagulated, and can be easily measured by a method such as optical microscopy, and can be used as an indicator of properties of the metal structure immediately after casting. In the present invention, it has been found that, when the DAS is controlled to be within an appropriate range, it is possible to realize an aluminum alloy ingot having favorable mechanical properties and reliability.

The present invention has been made based on the above findings, and an aluminum alloy ingot of the present invention contains Cu: 0.15 mass % or more and 1.0 mass % or less, Mg: 0.6 mass % or more and 1.2 mass % or less, Si: 0.95 mass % or more and 1.35 mass % or less, Mn: 0.4 mass % or more and 0.6 mass % or less, Fe: 0.15 mass % or more and 0.70 mass % or less, Cr: 0.09 mass % or more and 0.25 mass % or less, and Ti: 0.012 mass % or more and 0.035 mass % or less, with the remainder being made up of Al and unavoidable impurities, and in the aluminum alloy ingot, a difference between a maximum value and a minimum value of secondary dendrite arm spacing in a cross section perpendicular to a casting direction of the aluminum alloy ingot is in a range of 5 μm or more and 20 μm or less.

According to the present invention, when the difference between the maximum value and the minimum value of DASs is in a range of 5 μm or more and 20 μm or less, it is possible to obtain an aluminum alloy rod that has favorable mechanical properties and has a large cross section perpendicular to the casting direction (for example, a diameter in a range of 10 mm or more and 100 mm or less).

In addition, in the present invention, the aluminum alloy ingot may further contain B: 0.0001 mass % or more and 0.03 mass % or less.

In addition, in the present invention, a standard deviation of the secondary dendrite arm spacing may be 5 μm or less.

A method for producing an aluminum alloy ingot of the present invention is a method for producing the aluminum alloy ingot according to each of the above items, performed using a horizontal continuous casting apparatus configured to supply an aluminum alloy molten metal in a molten metal receiving part from one end side of a hollow mold that is arranged so that a central axis of a hollow part is in a horizontal direction to the hollow part of the mold and produce an aluminum alloy ingot, the method including: continuously supplying the molten metal from one end side of the mold to the hollow part, and supplying cooling water to a cooling water cavity which is formed outside an inner circumferential surface of the hollow part and in which the cooling water that cools the inner circumferential surface is accommodated; and cooling and coagulating the molten metal under conditions in which a heat flux value per unit area in a cooling wall part of the mold between the inner circumferential surface and an inner bottom surface of the cooling water cavity that forms a surface parallel to the inner circumferential surface is $10\times10^5$ W/m$^2$ or more.

In addition, in the present invention, the cooling wall part of the mold may be formed to have a thickness in a range of 0.5 mm or more and 3.0 mm or less.

Advantageous Effects of Invention

According to the present invention, it is possible to provide an aluminum alloy ingot in which the metal structure is made fine and uniform by applying a high cooling rate and the non-uniformity of the metal structure is minimized inside the ingot, and a method for producing the same.

DESCRIPTION OF EMBODIMENTS

Figure 1:
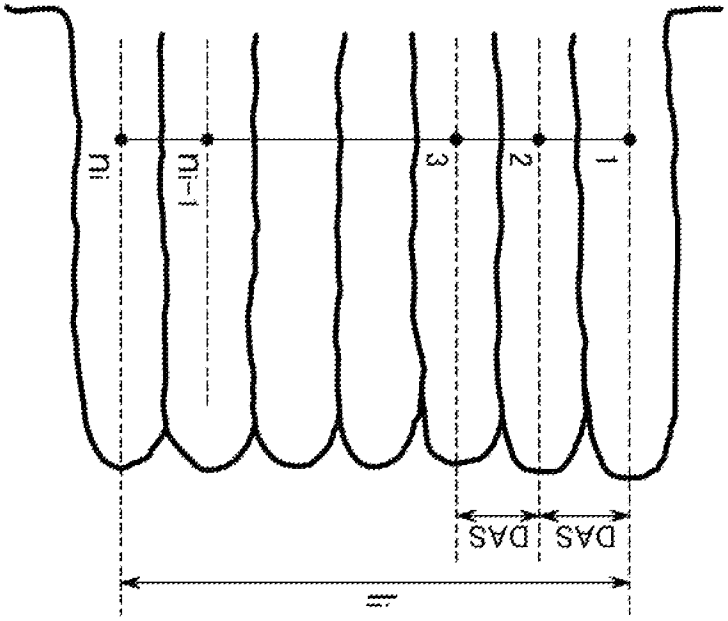
FIG. 1 is a schematic view showing a distance between centers (DAS) of secondary arms of dendrites.

Hereinafter, an aluminum alloy ingot according to one embodiment of the present invention and a method for producing the same will be described with reference to the drawings. Here, the embodiments shown below are described in detail for better understanding of the spirit of the invention, and do no limit the present invention unless otherwise specified. In addition, in the drawings used in the following description, in order to facilitate understanding of features of the present invention, main parts are enlarged for convenience of illustration in some cases, and dimensional ratios of components are not necessarily the same as actual ones.

(Aluminum Alloy Ingot)

An aluminum alloy ingot of the present embodiment is an aluminum alloy rod with a circular cross section, which is cast by a method for producing an aluminum alloy ingot to be described below, and has a composition including Cu: 0.15 mass % or more and 1.0 mass % or less, Mg: 0.6 mass % or more and 1.2 mass % or less, Si: 0.95 mass % or more and 1.35 mass % or less, Mn: 0.4 mass % or more and 0.6 mass % or less, Fe: 0.15 mass % or more and 0.70 mass % or less, Cr: 0.09 mass % or more and 0.25 mass % or less, and Ti: 0.012 mass % or more and 0.035 mass % or less, with the remainder being made up of Al and unavoidable impurities. Here, it may further contain B: 0.0001 mass % or more and 0.03 mass % or less in addition to the above components.

In such an aluminum alloy rod, the difference between the maximum value and the minimum value of DASs in the cross section perpendicular to the casting direction is in a range of 5 μm or more and 20 μm or less. In addition, the standard deviation of DASs is preferably 5 μm or less.

Here, the DAS can be measured by, for example, the method for measuring a secondary dendrite arm spacing described in Non-Patent Document 2.

Non-Patent Document 2: Japan Society of Light Metals, Casting and Solidification Subcommittee: light metals, 38 (1998), 54-60.

As shown in FIG. 1, the DAS is a distance between centers of secondary arms of adjacent dendrites. Such DAS measurement can be applied to metal structures in which secondary arms of dendrites have developed, there are relatively many dendrites with aligned arms, and there is no problem in measurement of the arm spacing. In the measurement, a part in which secondary arms of dendrites or arms determined to be secondary arms are aligned is selected and measured on an arbitrary observation plane.

In the aluminum alloy rod of the present embodiment, when the difference between the maximum value and the minimum value of DASs is in a range of 5 μm or more and 20 μm or less, it is possible to obtain an aluminum alloy rod that has favorable mechanical properties and has a large cross section perpendicular to the casting direction (for example, a diameter in a range of 10 mm or more and 100 mm or less).

When the difference between the maximum value and the minimum value of DASs is less than 5 μm, it is necessary to make the ingot into a thin-wall shape, which limits applicable uses. On the other hand, when the difference between the maximum value and the minimum value of DASs is more than 20 μm, the degree of non-uniformity of the metal structure inside the ingot becomes too large, and the mechanical properties of the ingot deteriorate.

In addition, in the aluminum alloy rod of the present embodiment, when the standard deviation of DASs is 5 μm or less, it is possible to obtain an aluminum alloy rod that has favorable mechanical properties and has a large cross section perpendicular to the casting direction (for example, a diameter in a range of 10 mm or more and 100 mm or less).

When the standard deviation of DASs is more than 5 μm, the degree of non-uniformity of the metal structure inside the ingot becomes too large, and the mechanical properties of the ingot deteriorate.

(Method for Producing Aluminum Alloy Ingot)

Next, a method for producing the aluminum alloy rod (aluminum alloy ingot) having secondary dendrite arm spacing described above will be described.

The above aluminum alloy rod is, for example, produced by a horizontal continuous casting method using a hollow cylindrical mold which is held so that its central axis is substantially horizontal (substantially horizontal means that it is in a lateral direction) and includes a cooling unit, and has a diameter, for example, in a range of 10 mm or more and 100 mm or less.

Although diameters outside this range can be accommodated in the aluminum alloy rod, in order to make a facility for industrial post-process plastic processing, for example, forging, roll forging, drawing processing, rolling processing, or impact processing, small and inexpensive, the diameter is preferably in a range of 10 mm or more and 100 mm or less. When the diameter is changed and casting is performed, this can be handled by replacing the mold with a removable cylindrical mold having an inner diameter corresponding to the diameter, and changing the molten metal temperature and the casting speed accordingly. The settings for the amount of cooling water and the amount of lubricating oil may be changed as necessary.

Such an aluminum alloy rod is used, for example, as a material for plastic processing in the post-processing, for example, forging, roll forging, drawing processing, rolling processing, and impact processing. Alternatively, it can be used as a material for mechanical processing such as bar machining and drilling processing.

Figure 2:
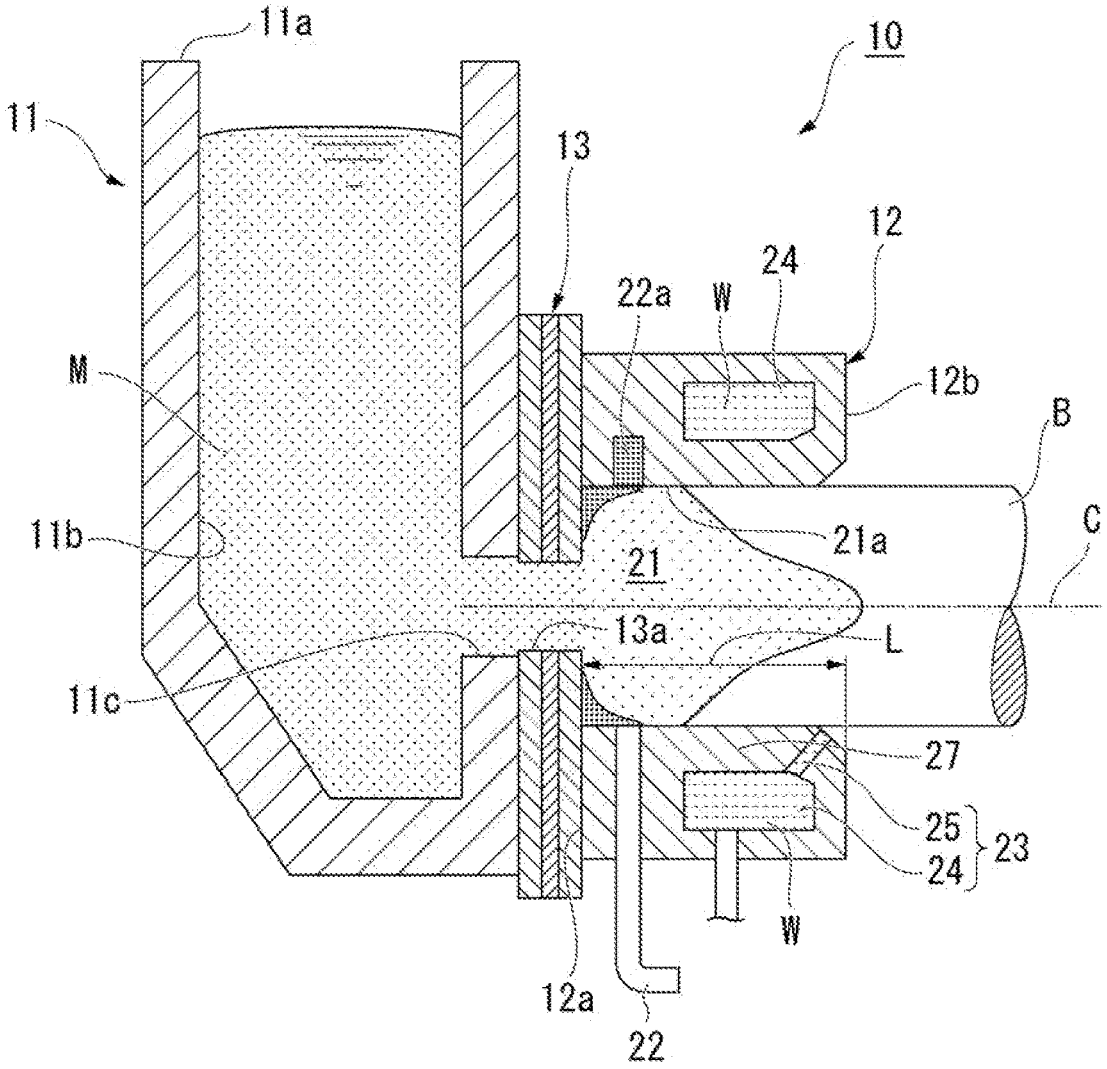
FIG. 2 is a cross-sectional view showing an example of the vicinity of a mold of a horizontal continuous casting apparatus for producing an aluminum alloy ingot of the present invention.

FIG. 2 is a cross-sectional view showing an example of the vicinity of a mold of a horizontal continuous casting apparatus for producing an aluminum alloy ingot of the present invention.

A horizontal continuous casting apparatus 10 according to the present embodiment includes a molten metal receiving part (tundish) 11, a hollow cylindrical mold 12, and a refractory plate (insulation member) 13 disposed between one end side 12*a* of the mold 12 and the molten metal receiving part 11.

The molten metal receiving part 11 is composed of a molten metal inflow part 11*a* that receives an aluminum alloy molten metal (hereinafter referred to as an alloy molten metal) M adjusted to a specified alloy component by an external melting furnace or the like, a molten metal holding part 11*b*, and an outflow part 11*c* toward a hollow part 21 of the mold 12. The molten metal receiving part 11 maintains the level of the upper liquid surface of the alloy molten metal M at a position higher than the upper surface of the hollow part 21 of the mold 12, and in the case of continuous casting, stably distributes the alloy molten metal M to each mold 12.

The alloy molten metal M held in the molten metal holding part 11*b* in the molten metal receiving part 11 is poured into the hollow part 21 of the mold 12 through a pouring path 13*a* provided at the refractory plate 13. Then, the alloy molten metal M supplied into the hollow part 21 is cooled and solidified by a cooling apparatus 23 to be described below, and is drawn out from the other end side 12*b* of the mold 12 as an aluminum alloy rod B which is a coagulated ingot.

A drawer drive device (not shown) that draws out the cast aluminum alloy rod B at a certain speed may be installed on the other end side 12*b* of the mold 12. In addition, it is preferable that a synchronous cutting machine (not shown) that cuts the continuous drawn aluminum alloy rod B to an arbitrary length be installed.

The refractory plate 13 is a member that blocks heat transfer between the molten metal receiving part 11 and the mold 12, and may be made of a material, for example, calcium silicate, alumina, silica, a mixture of alumina and silica, silicon nitride, silicon carbide, graphite or the like. Such a refractory plate 13 can also be composed of a plurality of layers made of different constituent materials.

The mold 12 is a hollow cylindrical member in the present embodiment, and is, for example, formed of one material selected from among aluminum, copper, and alloys thereof or a combination of two or more thereof. For such a material of the mold 12, an optimal combination may be selected in consideration of thermal conductivity, heat resistance, and mechanical strength.

The hollow part 21 of the mold 12 is formed to have a circular cross section in order to make the aluminum alloy rod B to be cast into a cylindrical rod shape, and the mold 12 is held such that the mold central axis (central axis) C passing through the center of the hollow part 21 is substantially in the horizontal direction.

An inner circumferential surface 21*a* of the hollow part 21 of the mold 12 is formed at an elevation angle of 0 degrees or more and 3 degrees or less (more preferably 0 degrees or more and 1 degree or less) with respect to the mold central axis C in the casting direction (refer to FIG. 5) of the aluminum alloy rod B. That is, the inner circumferential surface 21*a* has a tapered structure that opens into a cone shape in the casting direction. Thus, the angle formed by the taper is the elevation angle.

When the elevation angle is less than 0 degrees, it is difficult to perform casting because resistance is applied on the other end side 12*b*, which is the mold outlet, when the aluminum alloy rod B is drawn out from the mold 12. On the other hand, when the elevation angle is more than 3 degrees, there are concerns that the degree of contact of the inner circumferential surface 21*a* with the alloy molten metal M will become insufficient, the effect of removing heat from the alloy molten metal M and the coagulated shell formed by cooling and solidifying it to the mold 12 will decrease, and thus coagulation will become insufficient. As a result, this is not preferable because there is a high possibility that a re-melted surface will occur on the surface of the aluminum alloy rod B or that casting troubles such as spraying of the uncoagulated alloy molten metal M from the end of the aluminum alloy rod B will be caused.

Here, in addition to the circular shape in the present embodiment, the cross-sectional shape (the planar shape when the hollow part 21 of the mold 12 is viewed from the other end side 21*b*) of the hollow part 21 of the mold 12 may be selected from among, for example, a triangular or rectangular cross-sectional shape, a polygonal shape, a semicircular shape, an elliptical shape, and an irregular cross-sectional shape having no symmetric axis or symmetric surface, according to the shape of the aluminum alloy rod to be cast.

On the one end side 12*a* of the mold 12, a fluid supply pipe 22 through which a lubricating fluid is supplied into the hollow part 21 of the mold 12 is arranged. As the lubricating fluid supplied from the fluid supply pipe 22, any one or more lubricating fluids selected from among gas lubricants and liquid lubricants can be used.

When both a gas lubricant and a liquid lubricant are supplied, it is preferable to provide respective fluid supply pipes separately. The lubricating fluid supplied under pressure from the fluid supply pipe 22 is supplied into the hollow part 21 of the mold 12 through an annular lubricant supply port 22*a*.

In the present embodiment, the pressure-fed lubricating fluid is supplied from the lubricant supply port 22*a* to the inner circumferential surface 21*a* of the mold 12. Here, the liquid lubricant may be heated to become a decomposed gas and supplied to the inner circumferential surface 21*a* of the mold 12. In addition, a porous material may be disposed in the lubricant supply port 22*a* and the lubricating fluid may be exuded to the inner circumferential surface 21*a* of the mold 12 through the porous material.

Inside the mold 12, the cooling apparatus 23 which is a cooling unit configured to cool and solidify the alloy molten metal M is formed. The cooling apparatus 23 of the present embodiment includes a cooling water cavity 24 that accommodates cooling water W for cooling the inner circumferential surface 21*a* of the hollow part 21 of the mold 12, and a cooling water injection path 25 that communicates between the cooling water cavity 24 and the hollow part 21 of the mold 12.

The cooling water cavity 24 is formed in an annular shape so that it surrounds the hollow part 21 outside the inner circumferential surface 21*a* of the hollow part 21 inside the mold 12, and the cooling water W is supplied through a cooling water supply pipe 26.

In the mold 12, the inner circumferential surface 21*a* is cooled with the cooling water W accommodated in the cooling water cavity 24, heat of the alloy molten metal M filled into the hollow part 21 of the mold 12 is removed from the surface of the mold 12 that comes into contact with the inner circumferential surface 21*a*, and a coagulated shell is formed on the surface of the alloy molten metal M.

In addition, in the cooling water injection path 25, cooling water is directly applied toward the aluminum alloy rod B from a shower opening 25*a* facing the hollow part 21 on the other end side 12*b* of the mold 12, and the aluminum alloy rod B is cooled. The longitudinal cross-sectional shape of the cooling water injection path 25 may be, for example, a semicircular shape, a pear shape, or a horseshoe shape, in addition to the circular shape in the present embodiment.

Here, in the present embodiment, the cooling water W supplied through the cooling water supply pipe 26 is first accommodated in the cooling water cavity 24 and cools the inner circumferential surface 21*a* of the hollow part 21 of the mold 12, and additionally, the cooling water W in the cooling water cavity 24 is injected toward the aluminum alloy rod B through the cooling water injection path 25, but it can be supplied through cooling water supply pipes of respective separate systems.

The length from the position at which the extension line of the central axis of the shower opening 25*a* of the cooling water injection path 25 touches the surface of the cast aluminum alloy rod B to the contact surface between the mold 12 and the refractory plate 13 is referred to as an effective mold length L, and this effective mold length Lis preferably, for example, 10 mm or more and 40 mm or less. When the effective mold length L is less than 10 mm, casting is not possible because a favorable film is not formed, and when the effective mold length Lis more than 40 mm, this is not preferable because there is no effect of forced cooling, coagulation by the mold wall becomes dominant, the contact resistance between the mold 12 and the alloy molten metal M or the aluminum alloy rod B becomes large, cracks occur on the casting surface and breakage occurs inside the mold, and thus casting becomes unstable.

It is preferable that operations of supply of cooling water to the cooling water cavity 24 and injection of cooling water from the shower opening 25*a* of the cooling water injection path 25 can be controlled by a control signal from a control device (not shown).

The cooling water cavity 24 is formed such that an inner bottom surface 24*a* near the hollow part 21 of the mold 12 is parallel to the inner circumferential surface 21*a* of the hollow part 21 of the mold 12. Parallel here means that the inner circumferential surface 21*a* of the hollow part 21 of the mold 12 is formed at an elevation angle of 0 degrees to 3 degrees with respect to the inner bottom surface 24*a* of the cooling water cavity 24, that is, the inner bottom surface 24*a* is tilted by more than 0 degrees and up to 3 degrees with respect to the inner circumferential surface 21*a*.

Figure 3:
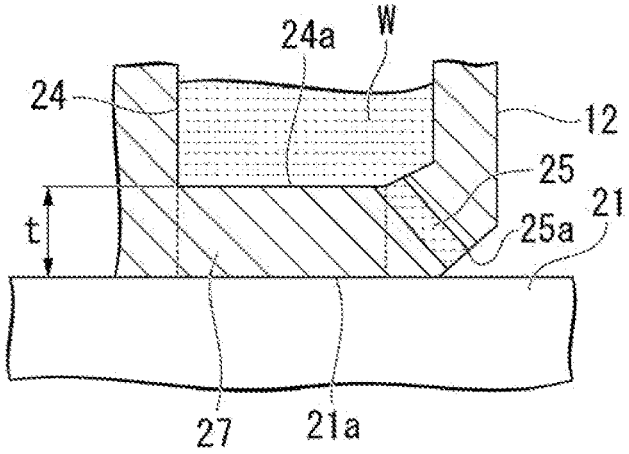
FIG. 3 is an enlarged cross-sectional view of main parts showing the vicinity of a cooling water cavity in FIG. 2.

As shown in FIG. 3, a cooling wall part 27 of the mold 12, which is a part in which the inner bottom surface 24*a* of the cooling water cavity 24 and the inner circumferential surface 21*a* of the hollow part 21 of the mold 12 face each other, is formed such that the heat flux value per unit area from the alloy molten metal M in the hollow part 21 toward the cooling water W in the cooling water cavity 24 is in a range of $10\times10^5$ W/m$^2$ or more and $50\times10^5$ W/m$^2$ or less.

The mold 12 may be formed such that the thickness t of the cooling wall part 27 of the mold 12, that is, the distance between the inner bottom surface 24*a* of the cooling water cavity 24 and the inner circumferential surface 21*a* of the hollow part 21 of the mold 12, is for example, in a range of 0.5 mm or more and 3.0 mm or less, and preferably 0.5 mm or more and 2.5 mm or less. In addition, the material for forming the mold 12 may be selected so that the thermal conductivity of at least the cooling wall part 27 of the mold 12 is in a range of 100 W/m· K or more and 400 W/m·K or less.

In FIG. 3, the alloy molten metal M in the molten metal receiving part 11 is supplied through the refractory plate 13 from the one end side 12*a* of the mold 12 that is held such that the mold central axis C is substantially horizontal, and forcedly cooled on the other end side 12*b* of the mold 12 to become the aluminum alloy rod B. Since the aluminum alloy rod B is drawn out at a certain speed by a drawer drive apparatus (not shown) installed near the other end side 12*b* of the mold 12, the long aluminum alloy rod B is formed by continuous casting. The drawn aluminum alloy rod B is cut into a desired length by, for example, a synchronous cutting machine (not shown).

The composition of the alloy molten metal M of the aluminum alloy stored in the molten metal receiving part 11 is the same as the composition of the above aluminum alloy rod, containing Cu: 0.15 mass % or more and 1.0 mass % or less, Mg: 0.6 mass % or more and 1.2 mass % or less, Si: 0.95 mass % or more and 1.35 mass % or less, Mn: 0.4 mass % or more and 0.6 mass % or less, Fe: 0.15 mass % or more and 0.70 mass % or less, Cr: 0.09 mass % or more and 0.25 mass % or less, and Ti: 0.012 mass % or more and 0.035 mass % or less, with the remainder being made up of Al and unavoidable impurities. The composition may further contain B: 0.0001 mass % or more and 0.03 mass % or less.

Here, the composition ratio of the cast aluminum alloy rod B can be confirmed, for example, by a method using an optical emission spectrometer (apparatus example: PDA-5500, commercially available from Shimadzu Corporation, Japan) as described in JIS H 1305.

The difference between the height of the liquid level of the alloy molten metal M stored in the molten metal receiving part 11 and the height from the upper inner circumferential surface 21*a* of the mold 12 is preferably 0 mm or more and 250 mm or less (more preferably, 50 mm or more and 170 mm or less). Within this range, the pressure of the alloy molten metal M supplied into the mold 12 and lubricating oils and gases vaporized from the lubricating oil are appropriately balanced so that castability is stabilized.

As the liquid lubricant, vegetable oils, which are lubricating oils, can be used. Examples thereof include rapeseed oil, castor oil, and salad oil. These are preferable because they have less adverse impact on the environment.

The lubricating oil supply rate is preferably 0.05 mL/min or more and 5 mL/min or less (more preferably, 0.1 mL/min or more and 1 mL/min or less). When the supply rate is too low, there is a risk of the alloy molten metal of the aluminum alloy rod B being not solidified and leaking from the mold due to insufficient lubrication. When the supply rate is too high, there is a risk of an excess component being mixed into the aluminum alloy rod B and internal defects occurring.

The casting speed, which is a speed at which the aluminum alloy rod B is pulled out from the mold 12 is preferably 200 mm/min or more and 1,500 mm/min or less (more preferably, 400 mm/min or more and 1,000 mm/min or less). This is because, when the casting speed is within this range, the network structure of crystals formed by casting becomes uniform and fine, the resistance to deformation of the aluminum fabric at a high temperature increases, and the high-temperature mechanical strength is improved.

The amount of cooling water injected from the shower opening 25*a* of the cooling water injection path 25 is preferably 10 L/min or more and 50 L/min or less (more preferably, 25 L/min or more and 40 L/min or less) per mold. When the amount of cooling water is smaller than this range, there is a risk of the alloy molten metal being not solidified and leaking from the mold. In addition, there is a risk of the surface of the cast aluminum alloy rod B being re-melted, and a non-uniform structure that remains as an internal defect being formed. On the other hand, when the amount of cooling water is larger than this range, there is a risk of too much heat being removed from the mold 12 and coagulation occurring during progress.

The average temperature of the alloy molten metal M flowing into the mold 12 from the inside of the molten metal receiving part 11 is preferably, for example, 650° C. or higher and 750° C. or lower (more preferably, 680° C. or higher and 720° C. or lower). When the temperature of the alloy molten metal M is too low, coarse crystals are formed in the mold 12 and in front of it, and incorporated into the aluminum alloy rod B as internal defects. On the other hand, when the temperature of the alloy molten metal M is too high, there is a risk of a large amount of hydrogen gas being likely to be incorporated into the alloy molten metal 255, and incorporated into the aluminum alloy rod B as pores, and creating an internal cavity.

Thus, as in the present embodiment, in the cooling wall part 27 of the mold 12, when the heat flux value per unit area from the alloy molten metal M in the hollow part 21 toward the cooling water W in the cooling water cavity 24 is in a range of $10\times10^5$ W/m$^2$ or more and $50\times10^5$ W/m$^2$ or less, it is possible to prevent the aluminum alloy rod B from burning.

Figure 4:
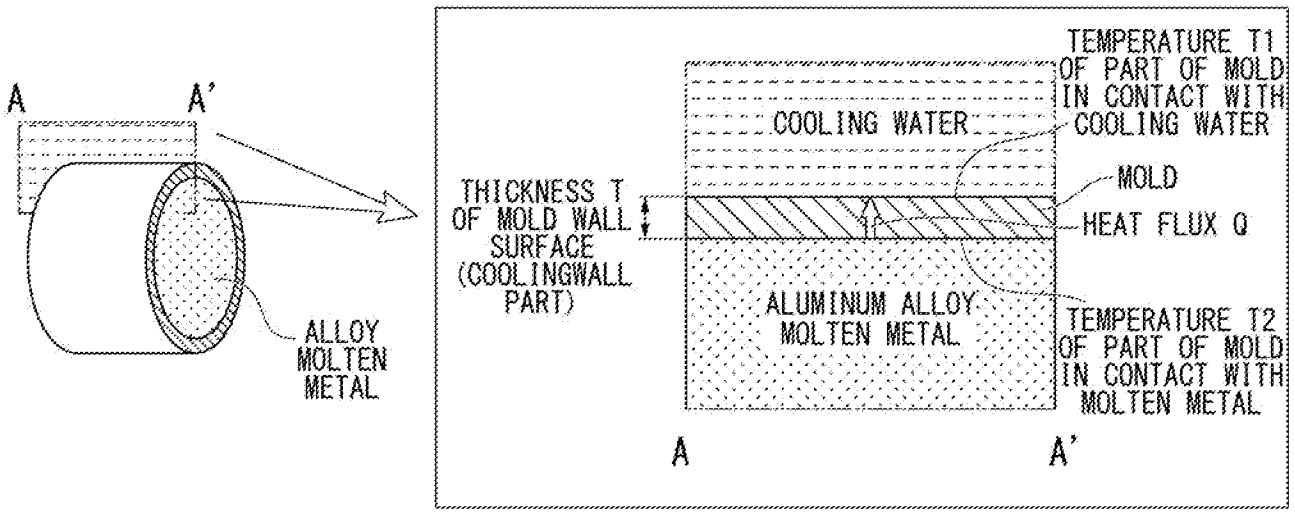
FIG. 4 is an illustrative diagram showing a heat flux of a cooling wall part of the horizontal continuous casting apparatus.

The cooling wall part 27 of the mold 12 receives heat due to heat removal from the alloy molten metal M, and performs heat exchange by cooling this heat with the cooling water W accommodated in the cooling water cavity 24, but regarding the state of this heat exchange, as shown in the illustrative diagram shown in FIG. 4, the heat flux per unit area has been focused on.

The heat flux per unit area is represented by the following Formula (1) according to the Fourier's law.

$$Q = -k \times ((T1 - T2/L) \quad (1)$$

Q: heat flux k: thermal conductivity (W/m. K) of the part through which heat passes (the cooling wall part 27 of the mold 12 in the present embodiment)

T1: low-temperature side temperature of the part through which heat passes (the inner bottom surface 24*a* of the cooling water cavity 24 in the present embodiment)

T2: high-temperature side temperature of the part through which heat passes (the inner circumferential surface 21*a* of the hollow part 21 of the mold 12 in the present embodiment)

L: section length (mm) of the part through which heat passes (the thickness t of the cooling wall part 27 of the mold 12 in the present embodiment)

Based on the mold material, thickness, and temperature measurement data with which favorable results are obtained even if the amount of lubricating oil is reduced during casting, when the cooling wall part 27 of the mold 12 is formed such that the heat flux value per unit area is $10\times10^5$ W/m$^2$ or more, it is possible to prevent the cast aluminum alloy rod B from burning. In addition, the heat flux value per unit area is preferably $50\times10^5$ W/m$^2$ or less.

In order for the cooling wall part 27 of the mold 12 to have such a heat flux value range, the mold 12 may be formed such that the thickness t of the cooling wall part 27 of the mold 12 is, for example, in a range of 0.5 mm or more and 3.0 mm or less. In addition, the thermal conductivity of at least the cooling wall part 27 of the mold 12 may be in a range of 100 W/m·K or more and 400 W/m·K or less.

When the aluminum alloy rod according to one embodiment of the present invention is produced, the alloy molten metal M stored in the molten metal receiving part 11 is continuously supplied from the one end side 12*a* of the mold 12 into the hollow part 21 using the above horizontal continuous casting apparatus. In addition, the cooling water W is supplied into the cooling water cavity 24 and a lubricating fluid, for example, lubricating oil, is also supplied from the fluid supply pipe 22.

Then, the alloy molten metal M supplied into the hollow part 21 is cooled and coagulated under conditions in which the heat flux value per unit area in the cooling wall part 27 is $10\times10^5$ W/m$^2$ or more, and the aluminum alloy rod B is cast. In addition, when the aluminum alloy rod B is cast, it is preferable that the wall surface temperature of the cooling wall part 27 of the mold 12 cooled with the cooling water W be set to be 100° C. or lower.

The aluminum alloy rod B obtained in this manner is cooled and coagulated under conditions in which the heat flux value per unit area in the cooling wall part 27 is $10\times10^5$ W/m$^2$ or more, and thus fixation of reaction products, for example, carbides, due to contact between the lubricating oil gas and the alloy molten metal M, is curbed. Thereby, there is no need to cut off and remove carbides and the like on the surface of the aluminum alloy rod B, and the aluminum alloy rod B can be produced with a high yield.

As described above, according to a method for producing an aluminum alloy ingot of the present embodiment, it is possible to realize an aluminum alloy ingot having a small degree of non-uniformity of the metal structure inside the ingot and excellent mechanical properties in which the inner bottom surface 24*a* of the cooling water cavity 24 and the inner circumferential surface 21*a* of the hollow part 21 of the mold 12 face each other, the heat flux value per unit area of the cooling wall part 27 of the mold 12 is $10\times10^5$ W/m$^2$ or more, and thus the difference between the maximum value and the minimum value of DASs in a cross section perpendicular to the casting direction is in a range of 5 μm or more and 20 μm or less, the standard deviation of the DASs is 5 μm or less.

Here, the method for producing an aluminum alloy ingot in which the difference between the maximum value and the minimum value of the secondary dendrite arm spacing in a cross section perpendicular to the casting direction of the aluminum alloy ingot is in a range of 5 μm or more and 20 μm or less according to the present invention is not limited to the above horizontal continuous casting method, and known continuous casting methods such as a vertical continuous casting method can be used. In addition, in order to improve the reliability of the final product, it is also preferable to appropriately perform a degassing treatment and a filter treatment on the molten metal.

While the embodiments of the present invention have been described above, these embodiments are only examples, and are not intended to limit the scope of the invention. These embodiments can be implemented in various other forms, and various omissions, substitutions and changes can be made without departing from the sprit and scope of the invention. These embodiments and modifications thereof are included in the spirit and scope of the invention and fall within the inventions described in the appended claims and equivalents thereof.

EXAMPLES

Effects of the present invention were verified.

For verification, an aluminum alloy ingot (aluminum alloy rod) having a circular cross section with a diameter of 49 mm was cast from the molten metal of the composition shown in Table 1 using the horizontal continuous casting apparatus 10 having the structure shown in FIG. 2. Here, the material for forming the mold of the horizontal continuous casting apparatus 10 was pure aluminum for an example and porous graphite for a comparative example.

TABLE 1

| | Element | | | | | | | |
|---|---|---|---|---|---|---|---|---|
| Composition | Si | Fe | Cu | Mn | Mg | Cr | Ti | Al |
| (wt. %) | 1.10 | 0.24 | 0.41 | 0.51 | 0.84 | 0.16 | 0.02 | Bal. |

Figure 5:
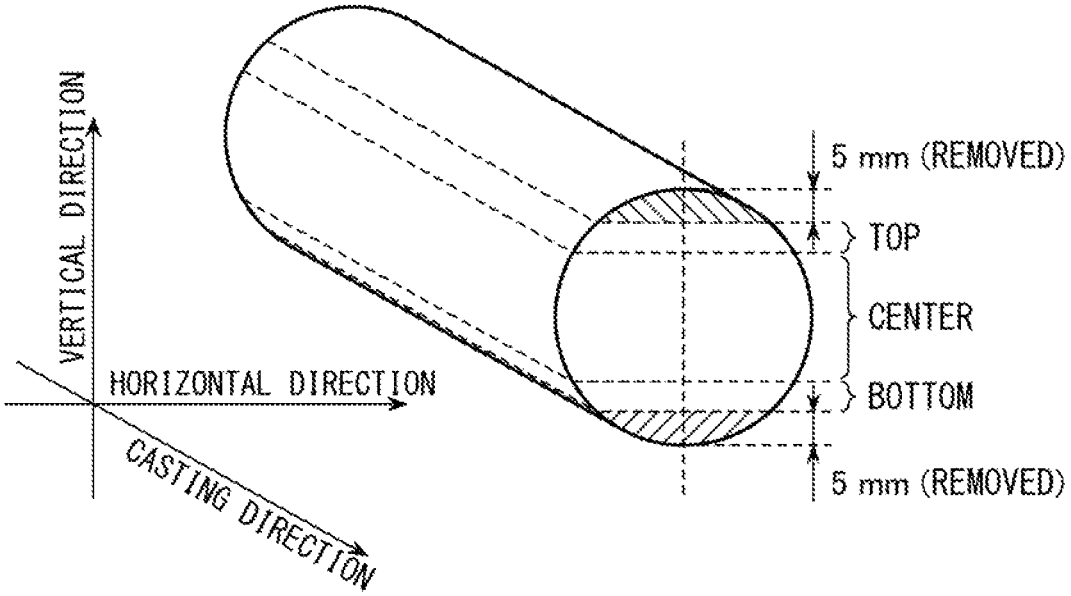
FIG. 5 is an illustrative diagram showing an aluminum alloy rod used in an example.

As shown in FIG. 5, a range of 5 mm in an upper end and 5 mm in a lower end was removed from the aluminum alloy rods of the example and the comparative example in the vertical direction, the DAS was measured in three fields of view in each of three top, center, and bottom regions, and the standard deviation was calculated.

The DAS was measured according to the secondary arm method specified in the above Non-Patent Document 2. This secondary arm method was applied to structures in which secondary dendrite arms have developed, relatively many dendrites with aligned arms were observed, and there was no problem in measurement of the arm spacing. The DAS was measured on a circular cross section of the aluminum alloy rod obtained by the above method cut in a direction perpendicular to the casting direction.

As a pretreatment for the measurement surface, mirror finishing was performed by sequentially performing polishing with emery paper, polishing with diamond paste, and buff polishing using a colloidal silica suspension, and additionally, crystal grain boundaries were exposed by Barker etching. Observation was performed under an optical microscope at a magnification of 100, and a part in which dendrites were clearly observed was a measurement target.

Here, in a region about 10 mm from the surface layer of the aluminum alloy rod obtained by the horizontal continuous casting apparatus 10, the molten metal that had flowed into the mold was rapidly cooled and a coagulated shell was formed so that a coagulation structure different from that of the central equiaxed crystal region was formed. As a general tendency, at a position up to 5 mm from the outermost surface of the ingot, since a structure suitable for DAS measurement using the above secondary arm method could not be obtained, as shown in FIG. 5, excluding regions 5 mm from the upper end and the lower end, the region was divided into three regions: the top from a position of 5 mm to a position of 10 mm from the upper end, the center, and the bottom from a position of 5 mm to a position of 10 mm from the lower end, and the DAS was measured in each of the regions.

The field of view for DAS measurement was a field of view including three crystal grains in which three or more secondary arms were clearly observed. As shown in FIG. 1, a line segment connecting the centers of aligned arms was drawn, and as shown in Formula 2, the DAS was calculated by dividing the line segment length $l_i$ by the number of intersection points $n_i$ between the line segment and the center of each arm.

$$DAS = \Sigma_i l_i / \Sigma_i n_i \tag{2}$$

In the measurement, the DAS was measured in three randomly selected fields of view for one region, and the DAS was measured at a total of 9 locations for one sample. According to these measurement results, the difference between the maximum value and the minimum value and the standard deviation were calculated.

These results are shown in Table 2.

TABLE 2

| Casting conditions | Measurement region | Field of view | DAS (μm) | Maximum | Minimum | Maximum − Minimum | Standard deviation |
|---|---|---|---|---|---|---|---|
| Example | top | 1 | 24 | 24 | 13 | 11 | 4.4 |
| | | 2 | 18 | | | | |
| | | 3 | 14 | | | | |
| | center | 1 | 13 | | | | |
| | | 2 | 14 | | | | |
| | | 3 | 15 | | | | |

TABLE 2-continued

| Casting conditions | Measurement region | Field of view | DAS (μm) | Maximum | Minimum | Maximum − Minimum | Standard deviation |
|---|---|---|---|---|---|---|---|
| | bottom | 1 | 14 | | | | |
| | | 2 | 24 | | | | |
| | | 3 | 20 | | | | |
| Comparative Example | top | 1 | 12 | 32 | 9.5 | 23 | 8.4 |
| | | 2 | 15 | | | | |
| | | 3 | 10 | | | | |
| | center | 1 | 29 | | | | |
| | | 2 | 19 | | | | |
| | | 3 | 17 | | | | |
| | bottom | 1 | 32 | | | | |
| | | 2 | 25 | | | | |
| | | 3 | 30 | | | | |

Next, the mechanical properties of the cast aluminum alloy rods of the example and the comparative example were evaluated.

For evaluation of the mechanical properties, the aluminum alloy rods were subjected to a homogenizing treatment, a solution treatment, and an artificial aging treatment under conditions shown in Table 3.

TABLE 3

| Step | Heating rate | Holding temperature | Holding time | Note |
|---|---|---|---|---|
| Homogenizing treatment | 1° C./min | 470° C. | 7 h | air cooling |
| Solution treatment | 10° C./min | 545° C. | 3 h | hot water quenching at 60° C. |
| Artificial aging treatment | 2° C./min | 180° C. | 5 h | air cooling |

The mechanical properties after this artificial aging were evaluated according to the following procedure. That is, a test piece with a gauge length of 25.4 mm and a parallel section diameter of 6.4 mm was collected from an aluminum alloy rod after an artificial aging treatment and subjected to a tensile test at a rate of 2 mm/min at room temperature (25° C.), and the tensile strength, 0.2% proof stress, and the elongation at break were measured. These results are shown in Table 4.

TABLE 4

| Casting conditions | Tensile properties | | |
|---|---|---|---|
| | tensile strength (MPa) | 0.2% proof stress (MPa) | elongation at break (%) |
| Example | 400 | 356 | 14 |
| Comparative Example | 384 | 340 | 12 |

Based on the results shown in Table 4, it was confirmed that the aluminum alloy rod of the example that was cast so that the difference between the maximum value and the minimum value of the secondary dendrite arm spacing in the cross section perpendicular to the casting direction of the aluminum alloy ingot was in a range of 5 μm or more and 20 μm or less had better mechanical properties at room temperature than that of the comparative example. That is, according to the production method of the present invention, it was possible to obtain an aluminum alloy ingot having excellent mechanical properties.

REFERENCE SIGNS LIST

10 Horizontal continuous casting apparatus
11 Molten metal receiving part (tundish)
12 Mold
13 Refractory plate (insulation member)
21 Hollow part
21*a* Inner circumferential surface
23 Cooling apparatus
24 Cooling water cavity
24*a* Inner bottom surface
25 Cooling water injection path
26 Cooling water supply pipe
27 Cooling wall part
B Aluminum alloy rod
M Alloy molten metal
W Cooling water

The invention claimed is:

1. An aluminum alloy ingot including Cu: 0.15 mass % or more and 1.0 mass % or less, Mg: 0.6 mass % or more and 1.2 mass % or less, Si: 0.95 mass % or more and 1.35 mass % or less, Mn: 0.4 mass % or more and 0.6 mass % or less, Fe: 0.15 mass % or more and 0.70 mass % or less, Cr: 0.09 mass % or more and 0.25 mass % or less, and Ti: 0.012 mass % or more and 0.035 mass % or less, with the remainder being made up of Al and unavoidable impurities, wherein a difference between a maximum value and a minimum value of secondary dendrite arm spacing in a cross section perpendicular to a casting direction of the aluminum alloy ingot is in a range of 5 μm or more and 20 μm or less, and a standard deviation of the secondary dendrite arm spacing is 5 μm or less.

2. The aluminum alloy ingot according to claim 1, further including B: 0.0001 mass % or more and 0.03 mass % or less.

3. A method for producing the aluminum alloy ingot according to claim 1, performed using a horizontal continuous casting apparatus configured to supply an aluminum alloy molten metal in a molten metal receiving part from one end side of a hollow mold that is arranged so that a central axis of a hollow part is in a horizontal direction to the hollow part of the mold and produce an aluminum alloy ingot, the method comprising:

continuously supplying the molten metal from one end side of the mold to the hollow part, and supplying cooling water to a cooling water cavity which is formed outside an inner circumferential surface of the hollow part and in which the cooling water that cools the inner circumferential surface is accommodated; and cooling and coagulating the molten metal under conditions in which a heat flux value per unit area in a cooling wall part of the mold between the inner circumferential surface and an inner bottom surface of the cooling water cavity that forms a surface parallel to the inner circumferential surface is $10\times10^5$ W/m$^2$ or more.

4. The method for producing an aluminum alloy ingot according to claim 3, wherein the cooling wall part of the mold is formed to have a thickness in a range of 0.5 mm or more and 3.0 mm or less.

* * * * *